US005778580A

United States Patent [19]

Zarelius

[11] Patent Number: 5,778,580

[45] Date of Patent: Jul. 14, 1998

[54] SHEET-LIKE IMAGE CARRIER

[76] Inventor: Christer Zarelius, Skeppargatan 29, 114 52 Stockholm, Sweden

[21] Appl. No.: 619,504

[22] PCT Filed: Oct. 3, 1994

[86] PCT No.: PCT/SE94/00905

§ 371 Date: Apr. 4, 1996

§ 102(e) Date: Apr. 4, 1996

[87] PCT Pub. No.: WO95/10104

PCT Pub. Date: Apr. 13, 1995

[30] Foreign Application Priority Data

Oct. 5, 1993 [SE] Sweden ..... 9303238

[51] Int. Cl.[6] ..... G09F 15/00

[52] U.S. Cl. ..... 40/610; 40/603; 40/650; 40/661.01; 40/661.08; 160/351

[58] Field of Search ..... 40/584, 603, 604, 40/605, 610, 650, 661, 661.01, 661.08, 661.09; 160/351, 382, DIG. 16

[56] References Cited

U.S. PATENT DOCUMENTS

| | | | |
|---|---|---|---|
| 376,919 | 1/1888 | Shonk | 40/584 |
| 979,221 | 12/1910 | Tarr | 40/603 |
| 2,212,313 | 8/1940 | Avenson | 40/603 |
| 2,385,002 | 9/1945 | Jorgenson et al. | 40/603 |
| 2,654,970 | 10/1953 | Miller | 40/124.07 |
| 2,887,154 | 5/1959 | Morningstar et al. | 160/351 |
| 3,827,019 | 7/1974 | Serbu | 160/DIG. 16 X |
| 4,147,198 | 4/1979 | Ytter . | |
| 4,196,535 | 4/1980 | Heimo | 40/661 X |
| 4,448,231 | 5/1984 | Salkeld et al. . | |
| 4,530,175 | 7/1985 | Wellman | 40/661 |
| 4,744,189 | 5/1988 | Wilson | 40/908 X |
| 4,773,174 | 9/1988 | Boeniger et al. | 40/603 X |
| 4,825,930 | 5/1989 | Lindberg et al. . | |
| 4,865,111 | 9/1989 | Perutz | 160/351 X |
| 5,024,015 | 6/1991 | Quarles, Jr. | 40/605 |
| 5,352,149 | 10/1994 | Melashenko et al. | 160/351 X |
| 5,454,180 | 10/1995 | Volpe | 40/610 X |

FOREIGN PATENT DOCUMENTS

| | | |
|---|---|---|
| 3543100 | 6/1987 | Germany . |
| 334 090 | 6/1971 | Sweden . |
| 2 143 664 | 2/1985 | United Kingdom . |
| 2 172 734 | 9/1986 | United Kingdom . |
| WO 91/12402 | 8/1991 | WIPO . |

*Primary Examiner*—Brian K. Green
*Assistant Examiner*—Andrea Chop
*Attorney, Agent, or Firm*—Burns, Doane, Swecker & Mathis, L.L.P.

[57] ABSTRACT

An image display unit includes a sheet-like image carrier, the carrier having at least one edge, the carrier being bendable. The image display unit also includes a coupling device, the coupling device including at least a first and a second part, the first part of the coupling device being disposed proximate the at least one edge of the carrier and the second part of the coupling device being attached to the carrier at a distance from the at least one edge, the first and second parts of the coupling device defining a first carrier section, the first and second parts of the coupling device each being vertically-oriented strips and having first and second coupling structures, respectively, the first and second coupling structures being engageable with each other. The carrier has a second carrier section. The first carrier section is sufficiently flexible and large to permit bending of the first carrier section against a restoring spring force of the first carrier section into a generally tubular configuration permitting contact of the first and second coupling structures. When the first carrier section is bent against the restoring spring force and the first and second coupling structures are connected, the restoring spring force of the first carrier section causes the first and second coupling structures to engage, and the generally tubular configuration supports the second carrier section in an upright condition.

11 Claims, 4 Drawing Sheets

SHEET-LIKE IMAGE CARRIER

TECHNICAL FIELD

The present invention relates to an image or picture display unit, and then more particularly, but not exclusively, to an image display unit which includes a sheet-like image-carrying carrier having an outer shape which includes two mutually spaced edges, wherein the carrier has a stiffness and a flexibility which will enable the carrier, or a section thereof, to be readily bent or curved to a circular cross-section or similar cross-section, in which the aforesaid two edges meeting one another when the unit is erected to an image displaying state.

By picture or image displaying unit and by an image or picture carrier is meant every type of image, such as figures, text, colored surfaces, and also transparent sheets.

DESCRIPTION OF THE PRIOR ART

Several types of image display unit of the aforesaid kind are known to the art. For instance, it is known to use as an image or picture display unit an erectable and collapsible support device which, when erected, is able to support one or more image-carrying, normally flat carriers, by virtue of the coaction of a first part of a two-part coupling unit attached to the support device with a second part of the coupling unit which is attached to the carrier, these coupling parts preferably having the form of mutually coacting permanent magnets, whereby the carrier, which hangs from its upper edgepart, will rest against the support device in either a flat or a curved state.

The carrier can be transported in the form of one or more rolls, and any change in shape caused by rolling-up the carrier is compensated for when the carrier is hung-up against the support device.

U.S. Pat. No. 4,825,930 teaches a hinge system which is adapted for large picture or image display systems, having a frame or a support device onto which an image carrier or a wall part is attached.

Other examples of the known prior art are illustrated and described in U.S. Pat. Nos. 4,147,198 and 4,448,231, and International Patent Publication WO91/12402 (PCT/SE91/00090).

In the case of simpler display arrangements or image display units it is known to fasten an image carrier to a stiffened frame structure, or to fasten the image carrier to a rigid sheet of material or the like.

The present invention also relates to simpler display arrangements and to display arrangements having a display surface of smaller size, for instance measuring 0.5–2.0 m×1.0–4.0 m.

SUMMARY OF THE PRESENT INVENTION

Technical Problems

When studying the earlier known prior art as described above it will be seen that a technical problem resides in providing an image display unit which can be erected and collapsed in a simple manner, and which, in principle, is comprised of a highly flexible and preferably thin sheet-like image carrier onto which simple parts of a necessary coupling device have been fitted.

It will also be seen that a technical problem is one of creating conditions such that an image-carrying carrier which is not in itself sufficiently rigid to be able to stand upright, or which has been provided with complicated supporting devices, to enable such an image carrier to be stably erected and to be collapsed to a small and compact state, solely with the aid of a few simple strips and by particularly simple bending of a part-section of the carrier.

It will also be seen that a technical problem is one of realizing that the image carrier of the display unit must have an outer form and a contour such as to present two mutually opposite edges, normally and preferably mutually parallel edges.

It will also be seen that a technical problem is one of realizing the significance of choosing the carrier material and/or the material composition so as to obtain a degree of stiffness and flexibility that will enable the carrier to be readily rolled-up into the form of a cylinder which can be readily transported and which has a predetermined small diameter and which can be easily unrolled into a flat state with no appreciable deformation of the image carrier.

Another technical problem is one of realizing the significance of adapting each of the aforesaid edges to form a first part of a two-part coupling device, and/or to permit said edges to coact with a first part of said two-part coupling device.

It will also be seen that a technical problem resides in realizing the significance of attaching the second part of the coupling device at a given distance from said each edge and by adapting this distance so that a carrier section located between the edge and the second part of the coupling device can be readily bent to an arcuate shape so as to bring the first and the second parts of the coupling device into coaction with one another with the two edges facing one another, therewith also enabling the first and second part to be easily disengaged, wherein two laterally disposed arcuate or tubular parts and therewith associated edge-related carrier sections will function as supports for a carrier section located centrally between the tubular parts.

It will also be seen that a technical problem resides in realizing the significance of choosing material stiffness and flexibility, the length of the central carrier section and/or the cross-section of said tubular formations, such that when the carrier is an upright position the carrier will rest stably on a supporting surface and provide stable orientation of the intermediate carrier section, the term "stable" being adapted to specific requirements.

It will also be seen that a technical problem is one of in realizing the advantage that is gained when the material is pre-tensioned to an arcuate shape and that stability can be improved by selection of the radius of curvature.

It will also be seen that another technical problem resides in realizing the significance of forming one part of the coupling device or one part of a latching device from self-fastening tape, an angle profile, a hooked profile or the like.

Another technical problem is one of realizing the significance of forming a second part of the coupling device from a strip which is attached to the rear side of the carrier and which there forms a carrier support, particularly a vertical support, between the edge-related carrier sections and the central carrier section when the carrier is erected.

Another technical problem resides in using as the edge-related one part of the coupling device solely the aforesaid edge of a rail strip or like element attached to said edge, depending on the anticipated application of the display unit.

Another technical problem resides in realizing the significance of using as the second part of the coupling device an angle strip whose one leg is attached to the rear side of the carrier and whose other leg is provided with adhesive and/or friction-increasing and/or coupling means.

Another technical problem resides in realizing the advantages that are gained when the second part of the coupling device has the form of a strip which is attached to the rear side of the carrier and which has a labyrinth-like opening, or an opening of some other form, into which one edge of the carrier or a strip attached to said edge can be inserted.

According to the invention, the complete image carrier may be divided horizontally into two or more parts or sections where mutually facing edge-parts of said sections are able to coact with one another with the aid of horizontal, edge-related, continuous or discontinuous coupling means, such as short and/or long permanently magnetized strips, tongued and grooved strips, and like elements.

It will also be seen that a further technical problem is one of realizing the advantages that are afforded when the coupling devices are extended continuously or discontinuously along a central carrier section and extend partially into adjacent edge-orientated carrier sections, so as to achieve a stabilizing effect with regard to the complete image display unit in its erected and upright position.

Another technical problem is one of creating, with the aid of very simple means, conditions which will enable vertically extending, more or less round end-parts to be obtained.

Another technical problem with regard to a stiff carrier material which can be bent or curved to a small radius resides in achieving harmony between edge-orientated carrier sections and their radii of curvature and the length of the central carrier section and/or its convex curvature.

Another technical problem is one of realizing the possibilities of stabilizing the erected and upstanding carrier that are obtained by utilizing a change in shape of the carrier or a chosen curvature of the carrier, preferably that which occurs when the carrier is rolled-up.

SOLUTION

With the intention of solving one or more of the aforesaid technical problems, the present invention takes as its starting point the ability of constructing an image display unit with the aid of a sheet-like image carrier which has an outer shape and contour such as to present two mutually spaced edges, wherein the carrier has a stiffness and a flexibility which enables the carrier to be readily curved to a circular or similar cross-section of predetermined radius and which enables the carrier to return to a flat or a generally flat state with no appreciable or at least troublesome residual or permanent deformation.

In the case of a display unit of this kind comprising a sheet-like image carrier having the aforesaid degree of stiffness and flexibility, it is proposed in accordance with the invention that with the intention of providing an image display unit which in an extended or upstanding state will display the image, picture, but which can be rolled-up to a suitable transportation stated, that each of the aforesaid edges will either form and/or coact with a first part of an at least two-part coupling device, and that the second part of said device is attached to the rear side of the carrier at a determined distance from said edge, such as to form a delimited edge-related carrier section between said edge and said coupling part; and that the distance is so adapted as to enable that part of the carrier which is located within said distance to be readily curved to a generally tubular configuration which will serve as a support when the display unit is erected and which has a generally circular cross-section, and so as to enable the first and the second coupling parts to be brought into and out of engagement with another in a simple manner, wherein two laterally disposed tubular configurations and their associated edge-related carrier sections will function to support a flat or slight curved central carrier section located between said tubular configurations.

According to further developments of the invention that lie within the scope of the inventive concept, respective edges are able to coact with a self-fastening strip, an angle profile, a hook profile or like element that forms one part of the coupling device.

Another part of the coupling device has the form of a strip attached to the rear surface of the carrier and having a surface which faces towards said edge and which is provided with corresponding coupling means.

According to one embodiment, a second part of the coupling device has the form of an angle strip whose one leg is attached to the rear side of the carrier and the other leg of which includes an adhesive agent, alternatively a friction-enhancing and/or coupling means for coaction with said edge.

According to another embodiment, said second part of the coupling device has the form of a strip which is fastened to the carrier and which has a labyrinth-like opening, or an opening of some other appropriate form, into which said edge can be inserted.

According to another embodiment of the invention the carrier is divided horizontally into two or more parts or sections, wherein the sections can coact with one another through the medium of horizontal edge surfaces and preferably with the aid of horizontal edge-related coupling means, such as short and/or long magnetic strips, tongue-and-groove strips and the like.

The permanently magnetized strips will preferably extend across the central carrier section and partially into mutually adjacent edge-orientated carrier sections.

The use of a sheet-like carrier which has a slightly curved shape, such as a partially circular shape of large radius of curvature is also proposed.

ADVANTAGES

Those advantages that are primarily afforded by an image display unit constructed in accordance with the present invention reside in the provision of conditions which enable a thin flexible sheet-material, forming an image carrier, to obtain a stable state when the unit is erected, and to provide desirable tubular configurations or roundings laterally of the image presenting surface. The invention enables the use of a relatively thin carrier whose stiffness and flexibility will enable the carrier to be curved to a generally circular cross-section of predetermined radius or to some like cross-section, to facilitate erection and transportation of the display unit.

A BRIEF DESCRIPTION OF THE DRAWINGS

An embodiment of an inventive image display unit at present preferred and embodiments of a number of alternative coupling devices will now be described in more detail with reference to the accompanying drawings, in which FIG. 1 is a view from above of the rear side of an image-carrying sheet-like carrier on which there are mounted two second parts of respective coupling devices;

DESCRIPTION OF EMBODIMENTS AT PRESENT PREFERRED

Figure 1:
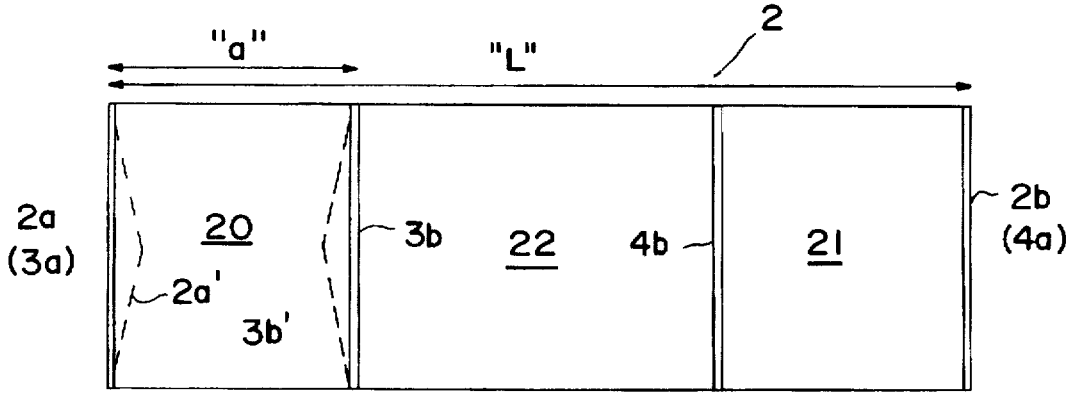

FIG. 1 is a view from above of the rear side of a sheet-like image carrier to measuring 1×3 meters.

Fastened to the rear side of the carrier are two strips 3B and 4B which serve as second parts of a respective two-part coupling device 3 and 4.

Figure 2:
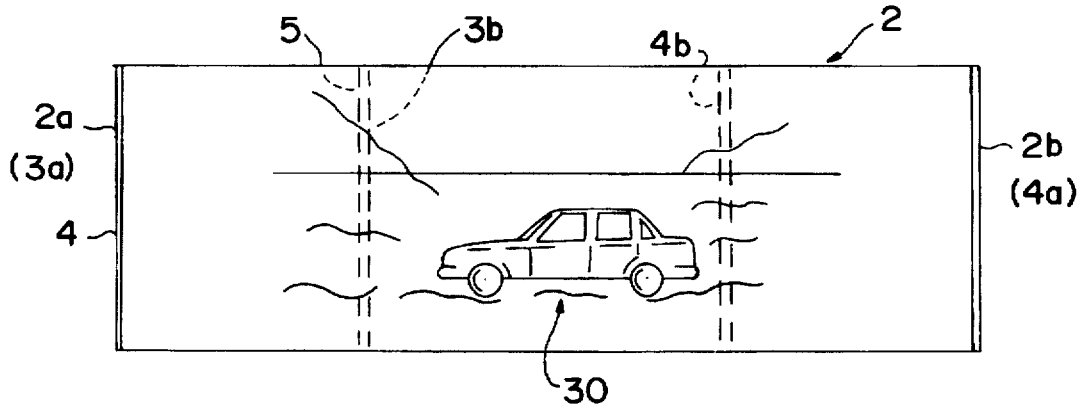
FIG. 2 is a view from above of the front side of the carrier shown in FIG. 1, which includes two first parts of respective coupling devices.
Figure 3:
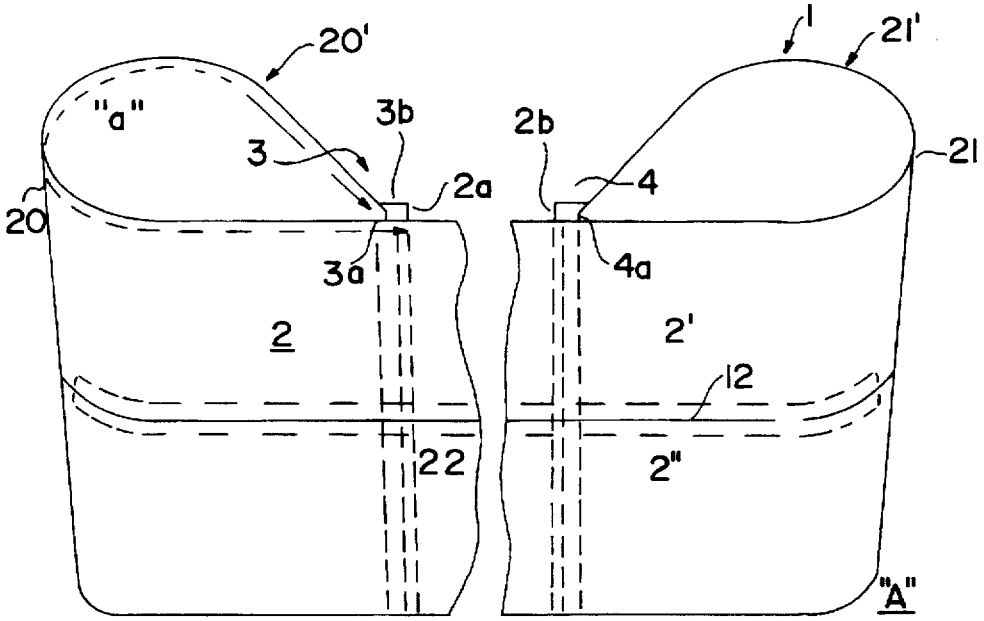
FIG. 3 is a perspective view of an image display unit when erected, this unit including two carrier parts or carrier sections positioned one Above the another.

By folding the edge-part 2A rearwardly (towards the viewer of FIG. 1 and away from the viewer of FIG. 2) into coaction with the second coupling part 3B, and by folding the edge-part 2B rearwardly into coaction with a similar second coupling part 4B, there is formed an inventive image display unit 1 when said unit is thereafter positioned in the manner shown in FIG. 3.

Thus, the image display unit 1 originally has the form of a generally flat and sheet-like image carrier 2, as shown in FIGS. 1 and 2, which has an outer shape such as to present two mutually separated edges 2A, 2B whereas the carrier in general has a rectangular shape for the sake of simplicity.

It will be understood, however, that other contours and shapes are conceivable.

The edges 2A, 2B need not be straight and parallel with one another, but may slope somewhat, which will normally require the second coupling parts, in the form of the parts or elements 3B and 4B, to slope correspondingly.

For instance, if the part 3B has the form referenced 3B', the edge 2A' will have a corresponding form, wherewith locking is effected by moving edge 2A' up and down in the groove 3B'.

If the part 3B is positioned obliquely to the edge 2A, there will be obtained a "truncated conical shape" with regard to the laterally disposed sections.

The carrier 2 will have a stiffness and a flexibility which will enable it to be readily curved to a tubular configuration of circular or like cross-section and to be rolled-up to a hollow cylindrical form. Minor deformations have no practical significance.

Figure 11:
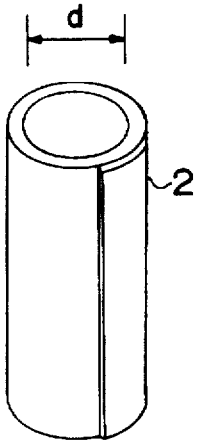
FIG. 11 is a perspective view of the carrier when rolled-up for transportation and dispatch.

It is proposed that when the display unit is rolled-up to the transportation state shown in FIG. 11 the circular cross-section will have a smallest diameter d between 0.1 and 0.5 m. The material from which the carrier 2 is made in general will be such that subsequent to being rolled-up to a hollow cylindrical form, the carrier can be opened up to a flat state with the aid of forces acting in the carrier, without suffering any appreciable deformation.

According to the invention, it is possible in certain applications to utilize deformation caused by rolling-up the display unit or caused in some other way, as described in more detail below. Each of the aforesaid edges 2A, 2B is intended to form and/or to coact with a first part 3A, 4A of the two-part coupling device 3 and 4 respectively.

The coupling devices 3 and 4 are identical to one another, and therefore only the coupling device 3 will be described in the following.

The coupling device 3 is comprised of a first coupling part 3A or solely the edge 2A, and a second coupling part 3B, wherein the coupling parts 3A, 3B are intended to be brought into firm, but readily disengaged engagement with one another.

This firm engagement is obtained through the use of the restoring spring forces generated by a curved sheet.

The second coupling part 3B is mounted at a distance "a" from the edge 2A and therewith defines an edge-orientated carrier section 20 (21). The distance "a" is such as to enable respective carrier sections 20 (21) located within said distance "a" to be readily curved to form a tubular or generally arcuate configuration 20' (21') with coaction between the first and the second parts of the coupling device 3, (4), wherein these coupling parts can be readily caused to disengage and wherein the two laterally positioned tubular configurations 20' (21') and the therewith associated edge-related carrier sections 20 (21) serve to support a carrier section 22 located centrally between the tubular configurations.

A larger tubular configuration 20' (21'), and therewith a larger supported surface against an underlying surface "A" and a smaller restoring spring force can be obtained by increasing the distance "a", although this will result in a smaller carrier section 22 between the tubular configurations.

The choice can be made by experimentation, where the shape of the material, its size, its stiffness, the surface area of the tubular configurations, the presence of any deformations, the type of coupling devices used, etc are decisive in this respect.

Figure 4:
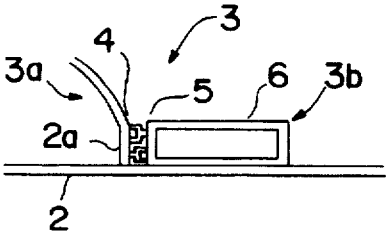
FIG. 4 is an end view of a first embodiment of one coupling device with the coupling parts shown in mutual coaction.

As shown in FIG. 4 respective edges, such as the edge 2A, coact with a self-fastening tape 4 which serves as a second coupling part of the coupling device 3, this self-fastening tape 4 coacting with a corresponding self-fastening tape 3 which serves as a second part of the coupling device and which is mounted on one edge surface of a strip 6. The strip 6 is secured to the carrier 2 in a known manner, with the aid of an adhesive.

Figure 5:
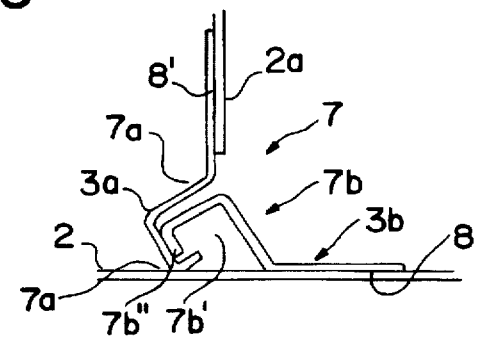
FIG. 5 is an end view of a second embodiment of a coupling device which comprises two mutually identical angle parts and shows the coupling parts in mutual coaction.

In the case of the FIG. 5 embodiment, the second coupling part 3B has the form of an angle strip 7, whose one leg 7B is secured to the carrier 2 with the aid of an adhesive 8, and whose other leg 7A is provided with an adhesive agent 8' intended for coaction with the edge part 2A.

In the case of the FIG. 5 embodiment the leg 7B includes an opening 7B' into which the similarly configured 7A extends. The part 7A' is so positioned as to be pressed by the carrier 2 into abutment with the leg 7B and its edge and surface 7B".

Figure 6:
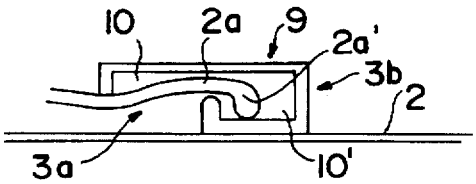
FIG. 6 is an end view of a third embodiment of a two part coupling device and shows the coupling parts in mutual coaction.

FIG. 6 illustrates an embodiment in which the second coupling part 3B has the form of a strip 9 which is fastened to the carrier 2 in a known manner and which includes a labyrinth-like opening 10 into which the first coupling part 3A, and therewith the edge 2A, can be inserted.

In this case, the edge 2A is conveniently provided with a thickening 2A', which is intended to be positioned in an inner cavity or recess 10' in the labyrinth-like opening 10.

Figure 7:
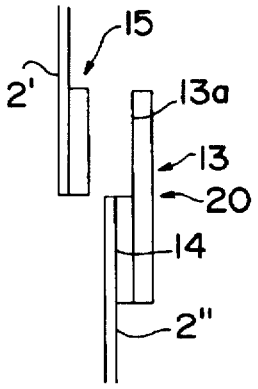
FIG. 7 is a sectional view which illustrates positioned upper and the lower carrier sections immediately before securing these sections together, with the aid of permanently magnetized coupling devices.

If it is assumed, as shown in FIG. 3, that the image display unit 1 comprises two mutually superimposed parts or sections 2", 2', divided by a horizontal dividing line 12, FIG. 7 shows that the part 2" is provided with a holder device 20 in the form of a magnetic strip 13 which is fastened to a corresponding magnetic strip 14 and which is also attached to the rear side of the carrier section 2". The lower or bottom edge of the carrier section 2' is provided with a magnetic strip 15 which is intended to be brought into coaction with the upper surface 13 A of the magnetic strip 13 and therewith secure the carrier sections 2' and 2", one to the other.

Figure 8:
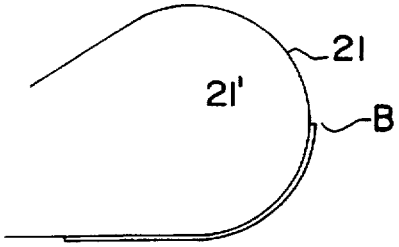
FIG. 8 is a horizontal view of one of the two tubular configurations.

In the FIG. 8 embodiment, the magnetic strips, or other holder means, 20 extend from the point "B" so as to facilitate coaction between the top 2' and the bottom 2" carrier sections.

Referring back to FIG. 3, it will be seen that the carrier 2 of this embodiment is divided horizontally into two or more parts or sections, of which the sections 2', 2" can be held together with the aid of edge-related holder means, such as the magnetic strips shown in FIG. 7.

The magnetic strips are intended to extend across the central carrier section 22 and partially, about 40–140 degrees, normally 60–100 degrees, into adjacent edge-orientated carrier sections 20, 21, in the manner illustrated in FIG. 8 with regard to a carrier section. Symmetry in this regard is preferred.

Figure 9:
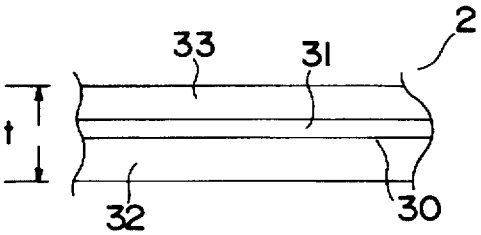
FIG. 9 is an enlarged cross-sectional view of a proposed sheet-like image carrier.

FIG. 9 is a cross-sectional view of a sheet-like image carrier 2, where an image 30 is applied on a sheet 31, preferably a very thin sheet 31, wherein a front plastic sheet 32 and a rear plastic sheet 33 are secured to the carrier 31 and therewith form a sheet-like image carrier 2 having a degree of elasticity and stiffness sufficient to provide the characteristic suppleness and like features required in accordance with the invention. The thickness "t" is about 0.5 mm.

It will be understood that there is nothing to prevent the choice of a stiffer image sheet and a single plastic sheet.

Irrespective of the choice made, the sheet can be produced in a completely flat state, or maybe in a slightly curved state, for instance given a partially circular-cylindrical shape with a large radius of curvature.

A curved carrier will provide a more stable construction when the display side is convexed.

Furthermore, the various sheets can be given respective different thicknesses and different degrees of stiffness or different properties, therewith enabling tension to be "incorporated" in the carrier.

This will enable the display unit to be rolled-up for transportation more easily, and will also provide greater stiffness/stability for a give width when the carrier is erected for display.

The radius of curvature may be related to the length (L) of the sheet, with a ratio of between L/4 to 10 L, preferably 4 L to 8 L.

The structure illustrated in FIG. 9 will normally have a thickness of between 0.3 and 1.0 mm.

Figure 10:
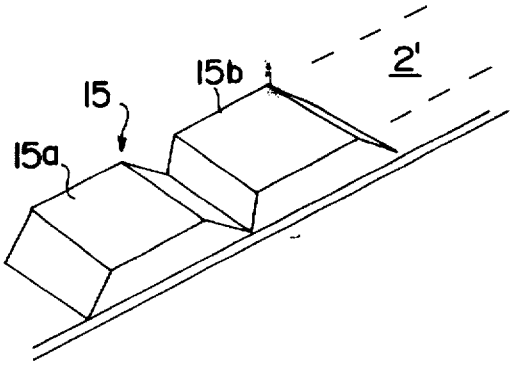
FIG. 10 is a perspective view of a magnetic tape which is effective in securing the sheet-like carrier when rolled-up into a roll of small radius.

FIG. 10 is a perspective view of a preferred embodiment of a permanently magnetized magnetic strip.

In this case, the magnetic strip 15 and other magnetic strips will include a number of discrete permanently magnetic sections, such as 15A, 15B, thereby enabling the carrier 2' to be rolled-up to a smaller diameter than when a continuous magnetic strip is used.

The sections 15A and 15B also enable the carrier sections 2' and 2" to be positioned precisely horizontally when the magnetic strip which includes the surface 13A is configured or magnetized in a corresponding manner.

Naturally, the shape and the magnetization direction of the part-section 15A, 15B can be varied.

With regard to the stiffness of the carrier, it shall be possible to roll a carrier having a thickness of 0.5 mm to a diameter of 0.15 m without resulting in troublesome permanent deformations in shape.

Figure 12:
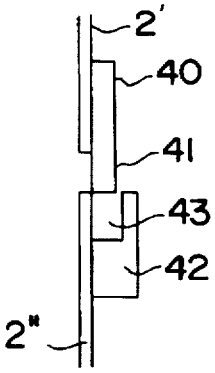
FIG. 12 is a sectional view which illustrates the positions of the upper and the lower sections of the image carrier immediately prior to bringing these sections into horizontal coaction with one another through the medium of simple mechanical coupling means.

In the embodiment illustrated in FIG. 12, a soft strip 40 having a tongue 41 is fastened to the upper carrier section 2', wherein the tongue 41 can be inserted in a soft strip 42 which is fastened to the carrier section 2" to form a groove 43, this coupling device functioning without magnetic attraction.

When the carrier 2 is rolled-up to a small radius, with the "rear side" of the carrier facing outwards, those deformations in shape that occur will generate a concave image display surface 22 and also generate a greater force effect when curving or bending the tubular configurations 20' and 21' which function to stiffen the unit 1 when in the state illustrated in FIG. 3, which means that generally the same stiffness will be obtained for a larger surface 22 and smaller tubular configurations 20' and 21'.

The expression "each of the edges is adapted to form and/or coact with a first part of an at least two-part coupling device" is to be meant that said part can be attached to the edge part at a distance from the edge line, say 1 to 10 cm, usually 2 to 5 cm, whereby the cross-section of the edge-oriented carrier section will tend to be more circular or more pear-formed. A circular cross-section is to be suggested preferrably due to the forces acting between the egde line and the material and the two parts constituting the two-part coupling device.

Figure 13:
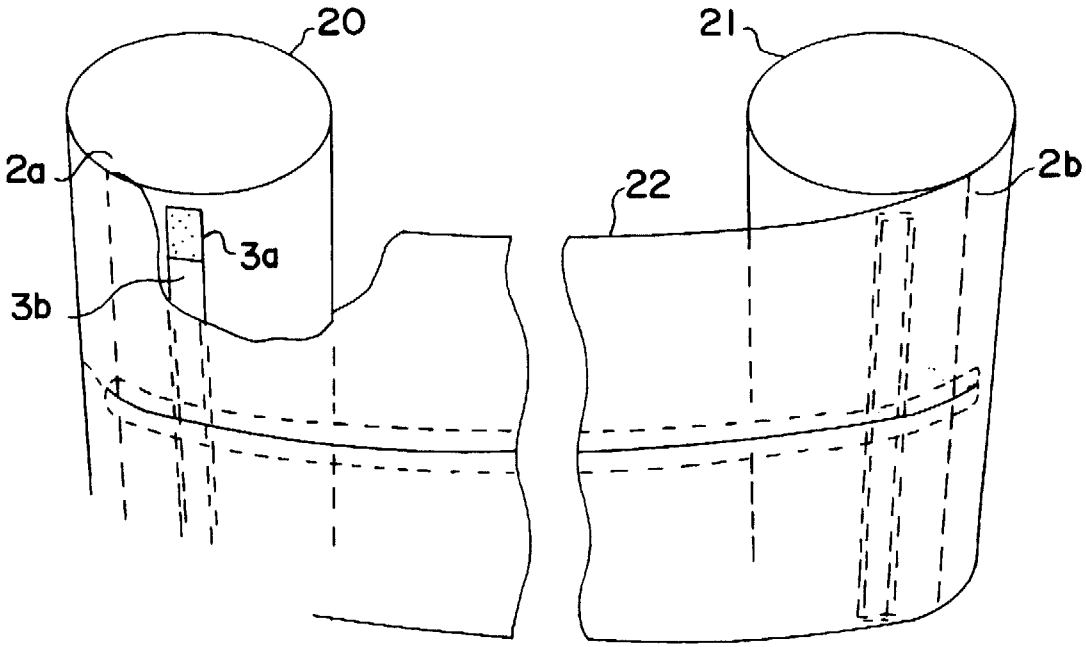
FIG. 13 shows a further arrangemant.

FIG. 13 illustrates this embodiment by using a coupling device in the form of a self fastening device, such as a VELCRO® fastener and by bending the material to a circular cross-section.

It will be understood that the invention is not restricted to the illustrated and described exemplifying embodiments thereof and that modifications can be made within the scope of the inventive concept as define in the following claims.

I claim:

1. An image display unit, comprising:

a sheet-like image carrier, the carrier having a length and a width dimension and at least one edge, the carrier being bendable;

a first coupling device, the first coupling device including at least a first and a second part, the first part of the first coupling device being disposed proximate the at least one edge of the carrier and the second part of the first coupling device being attached to the carrier at a distance from the at least one edge, the first and second parts of the first coupling device and a first intermediate carrier section defining a first carrier section, the first and second parts of the first coupling device each being width-oriented strips and having first and second coupling means, respectively, the first and second coupling means of the first carrier section being engageable with each other; and the carrier having a second carrier section defined by a first part and a second part of a second coupling device mutually exclusive of the first coupling device, and a second intermediate carrier section, the first and second parts of the second coupling device each being width-oriented strips and having first and second coupling means, respectively, the first and second coupling means of the second carrier section being engageable with each other;

the first carrier section and the second carrier section being sufficiently flexible and large to permit bending of the first intermediate carrier section and the second intermediate carrier section, respectively, against restoring spring forces of the first intermediate carrier section and the second intermediate carrier section, respectively, into generally tubular configurations permitting contact of the first and second coupling means of the first carrier section and of the second carrier section; and wherein, when the first carrier section and the second carrier section are bent against the restoring spring forces and the first and second coupling means of the first carrier section and the first and second coupling means of the second carrier section are connected, the generally tubular configurations are of sufficient size to support the first carrier section and the second carrier section in self-supporting conditions along the length dimension of the carrier.

2. A unit according to claim 1, wherein the first part of the first coupling device is attached to the carrier along the at least one edge of the carrier.

3. A unit according to claim 2, wherein a surface of the second part of the first coupling device forms the second coupling means of the first carrier section.

4. A unit according to claim 1, wherein a surface of the second part of the first coupling device forms the second coupling means of the first carrier section.

5. A unit according to claim 1, wherein the second part of the first coupling device is an angle strip.

6. A unit according to claim 1, wherein the second part of the first coupling device includes a labyrinth-like opening into which the at least one edge of the carrier is insertable.

7. A unit according to claim 6, wherein at least part of the at least one edge of the carrier is thicker than an adjacent interior portion of the carrier, the thicker part of the at least one edge of the carrier defining the first coupling means of the first carrier section.

8. A unit according to claim 1, wherein the carrier includes at least two length-wise divided sections.

9. A unit according to claim 8, wherein the two length-wise divided sections are connected by magnetic strips.

10. A unit according to claim 1, wherein the carrier includes a third carrier section which is curved.

11. A unit according to claim 1, wherein the first part of the first coupling device is an integral part of the at least one edge of the carrier.

* * * * *